US010502413B2

(12) United States Patent
Lankinen

(10) Patent No.: US 10,502,413 B2
(45) Date of Patent: Dec. 10, 2019

(54) CIRCULATING FLUIDIZED BED BOILER AND A METHOD OF ASSEMBLING A CIRCULATING FLUIDIZED BED BOILER

(71) Applicant: SUMITOMO SHI FW ENERGIA OY, Espoo (FI)

(72) Inventor: Pentti Lankinen, Varkaus (FI)

(73) Assignee: Sumitomo SHI FW Energia Oy, Espoo (FI)

( * ) Notice: Subject to any disclaimer, the term of this patent is extended or adjusted under 35 U.S.C. 154(b) by 99 days.

(21) Appl. No.: 15/738,639

(22) PCT Filed: Mar. 22, 2017

(86) PCT No.: PCT/FI2017/050197
§ 371 (c)(1),
(2) Date: Dec. 21, 2017

(87) PCT Pub. No.: WO2017/174865
PCT Pub. Date: Oct. 12, 2017

(65) Prior Publication Data

US 2018/0187884 A1 Jul. 5, 2018

(30) Foreign Application Priority Data

Apr. 4, 2016 (FI) ..... 20165287

(51) Int. Cl.
*F23C 10/10* (2006.01)
*F23J 11/00* (2006.01)
*F23M 5/08* (2006.01)

(52) U.S. Cl.
CPC ..... *F23C 10/10* (2013.01); *F23J 11/00* (2013.01); *F23M 5/08* (2013.01); *F23J 2211/00* (2013.01)

(58) Field of Classification Search
CPC ..... F23C 10/10
See application file for complete search history.

(56) References Cited

U.S. PATENT DOCUMENTS 4,745,884 A * 5/1988 Coulthard ..... B01J 8/1836 110/245
5,215,042 A * 6/1993 Beisswenger ..... B01J 8/386 110/245

(Continued)

FOREIGN PATENT DOCUMENTS

CN 201276531 Y 7/2009
CN 103486574 A 1/2014

OTHER PUBLICATIONS

Notification of and International Search Report and Written Opinion dated Aug. 10, 2017, in corresponding International Patent Application No. PCT/US2017/050197.

(Continued)

*Primary Examiner* — David J Laux
(74) *Attorney, Agent, or Firm* — Venable LLP

(57) ABSTRACT

A circulating fluidized bed boiler includes a rectangular furnace, which is horizontally enclosed by sidewalls, for combusting fuel and combustion gas and generating a stream of flue gas and particles. The sidewalls include first and second short sidewalls and first and second long sidewalls. Multiple particle separators are arranged on the side of each of the first and second long sidewalls for separating particles from the stream of flue gas and particles discharged from the furnace. Each of the particle separators includes a vertical gas outlet tube for discharging cleaned flue gas from the particle separator. A back pass arranged on the side of the second short sidewall of the furnace is horizontally enclosed by back pass walls. A horizontally extending cross over duct system is directly connected to the vertical gas outlet tubes of the particle separators for conducting the cleaned flue gas to the back pass.

19 Claims, 5 Drawing Sheets

(56) References Cited

U.S. PATENT DOCUMENTS

| | | | | |
|---|---|---|---|---|
| 7,244,400 | B2 * | 7/2007 | Darling | F22B 31/003 122/6 A |
| 7,971,558 | B2 * | 7/2011 | Baglione | F23C 10/10 122/4 D |
| 9,016,243 | B2 * | 4/2015 | Lankinen | F23C 10/10 122/379 |
| 9,518,730 | B2 * | 12/2016 | Lu | F23C 10/10 |
| 9,772,104 | B2 * | 9/2017 | Lv | F23C 10/10 |
| 10,156,354 | B2 * | 12/2018 | Lv | F22B 31/0084 |
| 2006/0011148 | A1 | 1/2006 | Baglione | |

OTHER PUBLICATIONS

Hotta, Arto, Ari Kettunen, and James Utt. "Milestones for CFB and OTU Technology, The 460 MWe Lagisza Supercritical Boiler Project Update," Aug. 1, 2017, Milwaukee, WI, pp. 1-8.

Morin, Jean-Xavier. "Recent ALSTOM POWER Large CFB and Scale up aspects including steps to Supercritical," 47th International Energy Agency Workshop on Large Scale CFB, Zlotnicki, Poland, Oct. 13, 2003, pp. 1-15.

* cited by examiner

CIRCULATING FLUIDIZED BED BOILER AND A METHOD OF ASSEMBLING A CIRCULATING FLUIDIZED BED BOILER

CLAIM OF PRIORITY

This application is a U.S. national stage application of PCT International Application No. PCT/FI2017/050197, filed Mar. 22, 2017, which claims priority from Finnish Patent Application No. 20165287, filed Apr. 4, 2016.

FIELD OF THE INVENTION

The present invention relates to a circulating fluidized bed (CFB) boiler, and, more specifically, relates to a CFB boiler comprising a rectangular furnace that is horizontally enclosed by first and second long sidewalls and by first and second short sidewalls, a back pass arranged on the side of the second short sidewall, multiple particle separators arranged on the side of each of the first and second long sidewalls, each of the particle separators comprising a vertical gas outlet tube for discharging cleaned flue gas from the particle separator, and a horizontally extending cross over duct system connected to the gas outlet tubes of the particle separators for conducting the cleaned flue gas to the back pass.

BACKGROUND OF THE INVENTION

Streams of flue gas and solid particles entrained therewith are generally discharged from the furnace of a large CFB boiler through multiple flue gas discharge channels to particle separators, usually, cyclone separators, arranged in parallel. Particles separated from the flue gas in the particle separators are returned back to the furnace, while cleaned flue gas is discharged from the particle separators through vertical gas outlet tubes and conducted via a horizontally extending cross over duct system to a back pass. Thermal energy is recovered from the flue gas in the back pass, and cooled flue gas is led from the back pass to different gas cleaning steps and, finally, to a stack, or, in oxyfuel combustion, to carbon dioxide sequestration.

CFB boilers usually have a furnace with a rectangular cross section, in which the width of the long sidewalls is clearly greater than the width of the short sidewalls. In small and medium size CFB boilers, typically having a capacity of about 300 MWe or less, there are usually from one to three particle separators, which are all arranged on one long sidewall of the boiler, and a back pass arranged in line with or opposite to the particle separators. Large size CFB boilers, having a capacity of more than about 300 MWe, usually have multiple particle separators arranged in a row on each of the two opposite long sidewalls of the furnace and a back pass arranged adjacent to a short sidewall of the furnace.

The cross over duct system from the outlet tubes of the particle separators to the back pass of large CFB boilers is usually fairly long, for example, more than thirty meters in the largest CFB boilers of today, and of a heavy construction. Therefore, the cross over duct system has to be well supported, in order to obtain sufficient stability and durability of the construction. Large CFB boilers are usually top-supported, i.e., the furnace, particle separators, and back pass, as well as the cross over duct system, are hanging from a supporting structure surrounding the boiler.

In a CFB boiler having particle separators on both long sidewalls of the furnace, the flue gas outlet tubes of the particle separators arranged on the same sidewall of the furnace are usually connected to a common cross over duct, which conducts the clean flue gases to the back pass. Naturally, such a boiler usually comprises two separate, symmetrically arranged cross over ducts, one on each of the long sidewalls of the furnace. Each of the cross over ducts comprises, conventionally, a main flue gas collecting duct arranged parallel to the long dimension of the horizontal cross section of the furnace and a gas flow bending end portion, for directing the flue gas to an opening in one or more of the sidewalls of the back pass.

Each of the main flue gas collecting ducts of a conventional large circulating fluidized bed boiler collects flue gas from, for example, three or four separators. Thus, the gas flow becomes, especially, at the final sections of a flue gas collecting duct, very high, and potentially eroding, unless the diameter or height of the flue gas duct increases towards the end. Such gradually widening flue gas ducts are, however, usually relatively complicated constructions. Another possibility is that the main flue gas collecting ducts have a constant cross section that is wide enough to maintain a sufficiently low flow velocity even at the end. Such a construction increases the weight of the main flue gas collecting ducts and may cause problems due to the non-constant velocity of the flue gas flow.

The main flue gas collecting ducts are usually arranged outside of the foot-print area of the furnace, especially, above the particle separators. Such cross over ducts then comprise a separate end portion for turning the flue gas streams to the back pass via openings in one or more of the sidewalls of the back pass. The article "Milestones for CFB and OTU Technology—The 460 MWe Lagisza Design Supercritical Boiler Project Update", presented in CoalGen Conference in Milwaukee, Wis., in August 2007, shows an example of a CFB boiler with a cross over duct system comprising a back pass on a short sidewall of the furnace, flue gas collecting ducts with a constant cross section parallel to the long sidewalls of the furnace and curved end portions for leading the flue gas to openings in the back pass wall facing the short sidewall of the furnace.

U.S. Pat. No. 7,244,400 discloses an alternative solution comprising curved outlet tubes of the particle separators connected to two flue gas collecting channels parallel to the long sidewalls of the furnace arranged at the roof of the furnace. The flue gas collection channels are integrated to the furnace by being constructed utilizing extensions of the furnace walls.

The article "Recent Alstom Power Large CFB and Scale up aspects including steps to Supercritical", presented at the 47th International Energy Agency Workshop on Large Scale CFB, Zlotnicki, Poland on Oct. 13, 2003, shows a large CFB boiler having three particle separators on each of the long sidewalls, in which the outlet ducts of the particle separators on each side are connected to a complicated cross over duct system comprising a straight collecting channel above the particle separators and a bent flue gas duct portion connecting the center of the collecting channel to the back pass.

SUMMARY OF THE INVENTION

In order to minimize problems of the prior art solutions described above, the present invention provides a circulating fluidized bed boiler comprising a rectangular furnace that is horizontally enclosed by sidewalls, for combusting fuel and combustion gas therein and generating a stream of flue gas and particles, the sidewalls comprising first and second short sidewalls and first and second long sidewalls, wherein a common width of the first and second long sidewalls is greater than a common width of the first and second short sidewalls, multiple particle separators arranged on the side of each of the first and second long sidewalls, inlets of the multiple particle separators being connected to an upper portion of each of the first and second long sidewalls, for separating particles from the stream of flue gas and particles discharged from the furnace, wherein each of the particle separators comprises a vertical gas outlet tube for discharging cleaned flue gas from the particle separator, a back pass arranged on the side of the second short sidewall of the furnace, the back pass being horizontally enclosed by back pass walls comprising a first back pass wall facing the second short sidewall of the furnace, and a horizontally extending cross over duct system directly connected to the vertical gas outlet tubes of the particle separators for conducting the cleaned flue gas to the back pass, wherein the cross over duct system provides a straight gas flow path that is inclined to the sidewalls of the furnace from each of the vertical gas outlet tubes of the of particle separators to openings in the first back pass wall.

The circulating fluidized bed boiler is advantageously top-supported, i.e., it comprises a supporting system, for hanging the furnace from above. The supporting system generally comprises vertical pillars, horizontal beams parallel to the long and short sidewalls of the furnace, and hanging rods for hanging different parts of the boiler, such as the furnace, from the horizontal beams. In order to provide a gas flow path from particle separators arranged on long sidewalls of a furnace to a back pass arranged on the side of a short sidewall of the furnace, a cross over duct system conventionally comprises sections parallel to the long and short sidewalls of the furnace. The reason for this is that a conventional cross over duct system has to be fitted in the space available between a generally rectangular net of vertical pillars, horizontal beams, and hanger rods of a supporting system.

According to the present invention, the cross over duct system provides a straight gas flow path that is inclined to the sidewalls of the furnace from each of the gas outlet tubes of the of particle separators to openings in the first back pass wall. The statement that the cross over duct system provides a straight gas flow path implies herein that the system has a shape that enables the flue gas to flow so as to have a straight flow direction, i.e., a direction that does not change during the path. The statement that the gas flow path, or gas flow direction, is inclined to a wall implies herein that the wall is planar, and thus, the wall has, at the respective location, a well-defined normal direction. Thus, the statement that the flow direction of the gas is inclined to the wall means, in this description, that the flow direction of the gas differs from the normal direction of the wall.

Because the cross over duct system according to the present invention provides straight gas flow paths, instead of paths comprising sections in different directions, for example, mutually perpendicular directions, the weight and costs of the present cross over duct system are generally less than those of a conventional cross over duct system. Moreover, by providing an ideal, straight path for the flue gas to the back pass, the present cross over duct system is less prone to harmful turbulence of the gas, and erosion of the duct system, than a conventional cross over duct system.

A cross over duct system providing an ideal straight gas flow path that is inclined to the sidewalls of the furnace from each of the gas outlet tubes of the of particle separators to openings in the first back pass wall is advantageously made possible by arranging the cross over duct system above the supporting system of the boiler. Therefore, the gas flow path does not have to be fitted between a net of pillars, beams, and hanger rods of the supporting system. The cross over duct system according to the present invention is, therefore, not top-supported, i.e., it is not arranged hanging from the supporting system, but the cross over duct system is advantageously supported from below by the supporting system, by using sliding support devices arranged on the supporting system. In order to eliminate problems due to different thermal expansions, the cross over duct system is preferably flexibly connected, for example, by using suitable bellows, to the vertical outlet tubes of the particle separators and to the first back pass wall.

According to a preferred embodiment of the present invention, the cross over duct system comprises two mirror symmetrically arranged portions, each of the portions connecting the vertical gas outlet tubes of particle separators adjacent to one of the two long sidewalls of the furnace to the back pass. Thus, the cross over duct system comprises a first duct structure providing a straight gas flow path that is inclined to the sidewalls of the furnace from each of the gas outlet tubes of the particle separators arranged on the side of the first long sidewall of the furnace to first openings in the first back pass wall, and a second duct structure providing a straight gas flow path that is inclined to the sidewalls of the furnace from each of the gas outlet tubes of the particle separators arranged on the side of the second long sidewall of the furnace to second openings in the first back pass wall.

The gas flow paths from the outlet tubes of different particle separators arranged on one of the long sidewalls of the furnace can have somewhat different directions, but, according to a preferred embodiment of the present invention, they all have the same direction, which can be called, simply, a gas flow direction. Thus, the first duct structure advantageously provides a first straight gas flow path parallel to a first gas flow direction that is inclined to the sidewalls of the furnace from each of the gas outlet tubes of the particle separators arranged on the side of the first long sidewall of the furnace to the first openings in the first back pass wall, and the second duct structure advantageously provides a second straight gas flow path parallel to a second gas flow direction that is inclined to the sidewalls of the furnace from each of the gas outlet tubes of the particle separators arranged on the side of the second long sidewall of the furnace to the second openings in the first back pass wall.

The vertical outlet tubes of the particle separators direct the flue gas streams upwards, whereafter, the flue gas streams have to turn ninety degrees, to the horizontal direction, to flow in the horizontally extending cross over duct system towards the back pass. An advantage of the present invention is that the flue gas streams can flow in the cross over duct system all the way to an opening in the first back pass wall along a straight path, without additional bends. The first back pass wall is generally perpendicular, or at least nearly perpendicular, to each of the long walls of the furnace, and the first and second gas flow directions are advantageously mirror symmetrically inclined to the sidewalls of the furnace.

According to a preferred embodiment of the present invention, each of the first and second duct structures is constructed as an open box, without partition walls. Due to the shape and construction of the duct structures, the flue gas flows in each of the first and second duct structures as a combined, single stream formed of multiple initial streams originating from the respective particle separators. More particularly, a first combined flue gas stream flows in the first duct structure in the first gas flow direction, and a second combined flue gas stream flows in the second duct structure in the second gas flow direction.

Each of the first and second duct structures preferably has a constant height, due to bottom and top walls at a constant level, and a width that increases stepwise, at connection points of the gas outlet tubes of the particle separators, in the respective flue gas flow direction. Due to the increasing cross-sectional area, the velocity of the flue gas remains approximately constant throughout the cross over ducts. Such a constant velocity renders possible a smooth flow of the flue gas without excessive turbulence and minimized erosion caused by particles entrained with the gas flow.

The cross over duct system is preferably cooled, i.e., it comprises water or steam tubes for transferring heat from the flue gas to water or steam. More particularly, the cross over duct system has a relatively simple shape that can be manufactured economically, and is advantageously made of straight water tube panels, to obtain a durable and light weight construction. Preferably, the cooled cross over duct system is internally protected, in order to further minimize erosion, by a refractory layer.

The first back pass wall is advantageously symmetrical about a vertical center line, the first openings, forming a first inlet opening area, and the second openings, forming a second opening area, being located on the respective sides of the vertical center line, at an upper section of the first back pass wall. According to a preferred embodiment of the present invention, each of the first and second opening areas comprises multiple substantially evenly distributed openings, and the first and second inlet opening areas together cover a portion of the first back pass wall that extends over most of the horizontal width of the first back pass wall. Due to the shape of the cross over duct system and the distribution of openings in the first back pass wall, the cross over duct system provides especially uniform distributions of temperature and velocity of the flue gas in the back pass. Thereby, the cross over duct system enables especially efficient and reliable heat recovery in the back pass.

According to a preferred embodiment of the present invention, the first back pass wall is planar and parallel to the second short sidewall of the furnace, whereby the first and second opening areas are on a plane having a normal direction that is inclined to the first and second gas flow directions. According to another preferred embodiment of the present invention, the first opening area is on a first planar wall portion and the second opening area is on a second planar wall portion, which first and second wall portions are horizontally adjacent to each other, and have different normal directions. Especially, each of the first and second wall portions has a central edge and an outermost edge, wherein the central edges are closer to the second short sidewall of the furnace than the outermost edges. According to a preferred embodiment, the first and second wall portions have a common central edge. The normal directions of the first and second wall portions preferably make an angle with the respective first and second gas flow directions that is smaller than it would be with a planar first back pass wall described above. Even more preferably, the angle is zero, i.e., the normal directions of the first and second wall portions are parallel to the first and second gas flow directions, respectively.

According to a preferred embodiment of the present invention, each of the first and second duct structures comprises at least one flow guide for directing flue gas flow from a first particle separator to the side of a vertical extension of the gas outlet tube of a second particle separator. The flow guide is advantageously made by forming the sidewall of the duct structure so as to guide the flue gas in a suitable manner. The flow guide minimizes harmful interference between a horizontal gas stream from an earlier particle separator and a gas stream entering to the duct structure through the outlet tube of a subsequent particle separator.

According to another aspect, the present invention provides a method of assembling a circulating fluidized bed boiler according to any of the embodiments described above, wherein the method comprises lifting each of the first and second duct structures as a single piece above horizontal beams of the supporting structure.

The above brief description, as well as further objects, features, and advantages of the present invention will be more fully appreciated by reference to the following detailed description of the currently preferred, but nonetheless illustrative, embodiments of the present invention, taken in conjunction with the accompanying drawings.

DETAILED DESCRIPTION OF THE PREFERRED EMBODIMENTS

Figure 1:
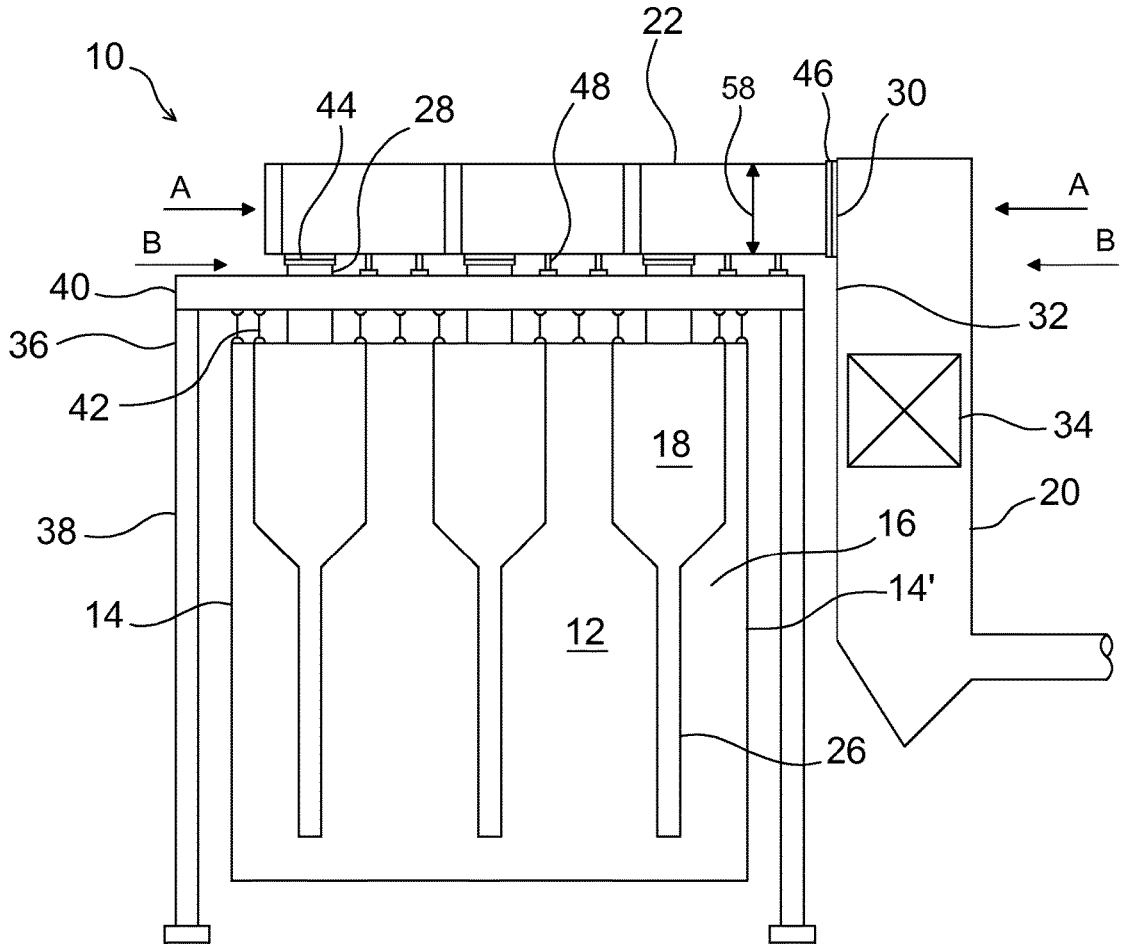
FIG. 1 is a schematic side view of a circulating fluidized bed boiler in accordance with a preferred embodiment of the present invention.

FIG. 1 shows a schematic side view of a circulating fluidized bed (CFB) boiler 10 in accordance with a preferred embodiment of the present invention. The furnace 12 of the CFB boiler 10 has a rectangular cross section, having first and second short sidewalls 14, 14' and first and second long sidewalls 16, only one of which is seen in FIG. 1. Multiple particle separators 18 are connected to each of the long sidewalls 16 of the furnace 12. The number of particle separators 18 on each long sidewall 16 is, here, three, but it could also be, for example, two, or four. The particle separators 18 are in flow connection with a back pass 20 arranged on the second short sidewall 14' of the furnace 12 by a horizontally extending cross over duct system 22. In the following, the same reference numbers are generally used for the same elements in different Figures.

Figure 2:
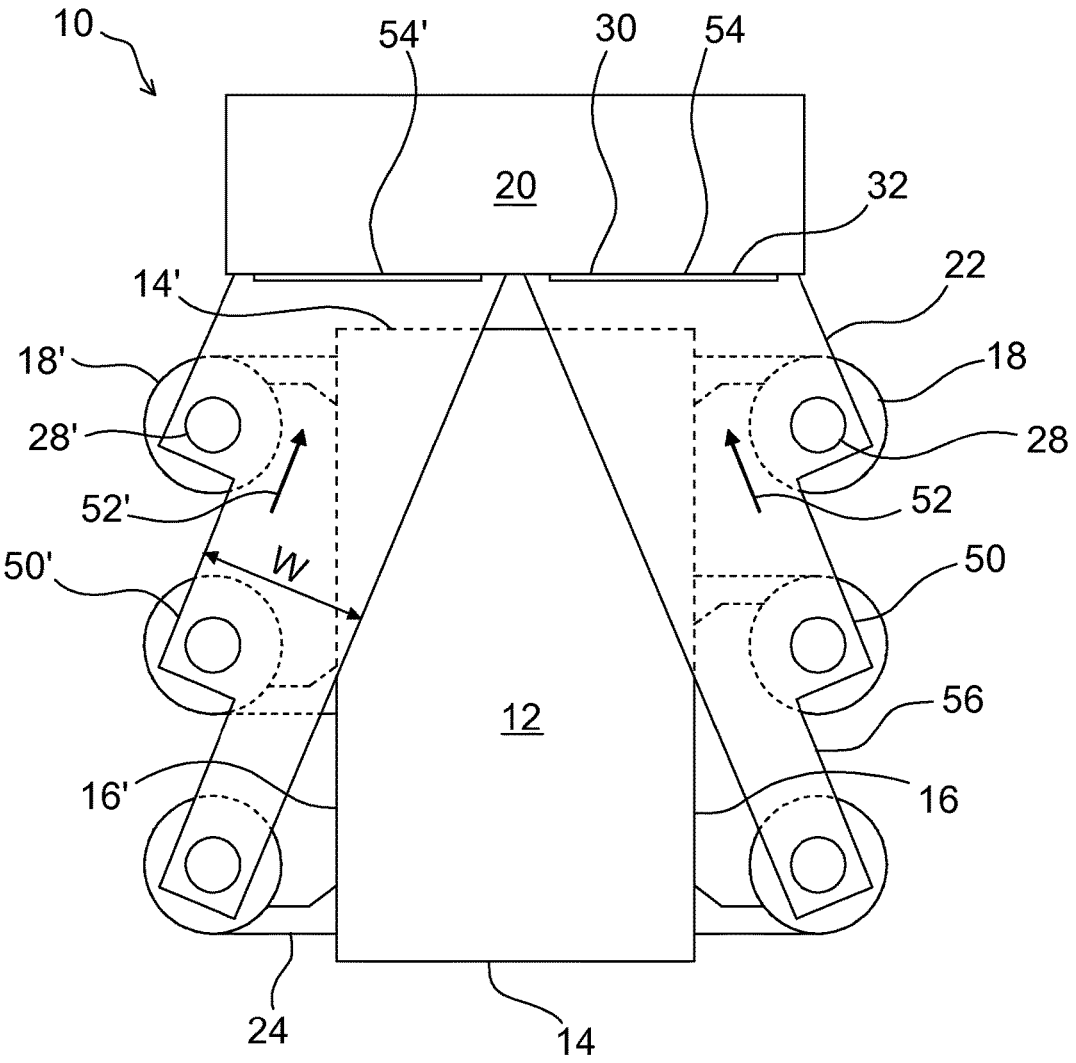
FIG. 2 is a schematic horizontal cross section of the circulating fluidized bed boiler shown in FIG. 1.

When fuel is combusted in the furnace 12, hot flue gas and particles entrained therewith are discharged through flue gas discharge channels 24, shown, e.g., in FIG. 2, to the particle separators 18. Particles separated from the flue gas in the particle separators 18, are returned back to the lower portion of the furnace 12 via return ducts 26. The return ducts 26 may advantageously comprise heat exchange surfaces, not shown in FIG. 1, to recover heat from the recycling hot particles.

Streams of cleaned flue gas are conducted from the particle separators 18 through vertical gas outlet tubes 28 to the cross over duct system 22, to be conducted through the cross over duct system to the back pass 20. The flue gas enters from the cross over duct system 22 to the back pass 20 through openings 30 arranged in a first back pass wall 32 facing the second short sidewall 14' of the furnace 12. According to the present invention, the cross over duct system 22 has a form that provides a straight gas flow path, that is inclined to the sidewalls of the furnace 12, from each of the vertical gas outlet tubes 28 of the particle separators 18 to the openings 30 in the first back pass wall 32.

The back pass 20 usually comprises heat exchange surfaces 34 for transferring heat from the flue gas to a heat transfer medium. In FIG. 1, there is symbolically shown only one heat exchange surface 34, but, in practice, there are usually several heat exchange surfaces 34, such as superheaters, reheaters, economizers, and air heaters.

Cooled flue gas is conducted from the back pass 20 further to gas cleaning stages, such as a dust collector and a sulfur dioxide scrubber, not shown in FIG. 1. The cleaned flue gas is finally released to the environment through a stack, or it is, in oxyfuel combustion, conducted further to carbon dioxide sequestration.

The circulating fluidized bed boiler 10 shown in FIG. 1 is of a conventional top-supported type, i.e., it comprises a supporting system 36 comprising vertical pillars 38, horizontal beams 40, and hanger rods 42, for hanging at least the furnace 12 from above. The back pass 20 is conventionally also of a top-supporting type and comprises a similar supporting system, not shown in FIG. 1. The cross over duct system 22 is advantageously arranged at a higher level than the supporting system 36 of the furnace 12, at least partially above the supporting system 36 of the furnace 12. Thereby, the cross over duct system 22 is advantageously bottom supported, i.e., it is supported from below by the supporting system 36.

Due to differential thermal expansions of the particle separators, 18, the cross over duct system 22 and the back pass 20, there are advantageously suitable bellows 44, 46, or other movement allowing structures, between the particle separators 18 and the cross over duct system 22, and between the cross over duct system 22 and the back pass 20, respectively. Due to differential thermal movements between the supporting system 36 and the cross over duct system 22, the cross over duct system 22 is advantageously supported on the supporting system 36 by using sliding support devices 48 arranged on the supporting system 36 of the furnace 12.

FIG. 2 schematically shows a horizontal cross section A-A of the embodiment shown in FIG. 1. For the sake of simplicity, the support construction, feature 36 in FIG. 1, is not shown in FIG. 2. As can be seen in FIG. 2, the cross over duct system 22 comprises two mirror symmetrically arranged portions 50, 50'. Thus, the cross over duct system 22 comprises a first duct structure 50 providing a straight gas flow path from the outlet tubes 28 of each of the particle separators 18 arranged on the side of the first long sidewall 16 of the furnace 12 to the first back pass wall 32, and a second duct structure 50' providing a straight gas flow path from the outlet tubes 28' of each of the particle separators 18' arranged on the side of the second long sidewall 16' of the furnace 12 to the first back pass wall 32.

The duct structures 50, 50' provide a straight, i.e., shortest possible, gas flow path from each of the particle separators 18, 18' to openings 30 in the first back pass wall 32. Because the particle separators 18, 18' are arranged on the two long sidewalls 16, 16' and the back pass 20 on a short side wall 14' of the furnace 12, the straight gas flow paths are naturally mirror symmetrically inclined to all sidewalls of the furnace 12.

Each of the duct structures 50, 50' is advantageously constructed without partition walls, and, therefore, the flue gas streams from the particle separators 18, 18' arranged on the same long sidewall 16, 16' form a combined flue gas stream. The combined flue gas streams in the first and second duct structures 50, 50' have first and second gas flow directions 52, 52', respectively, which are mirror symmetrically inclined to the sidewalls of the furnace 12. In order to keep the flue gas flow velocity at a substantially constant value throughout the duct structures 50, 50', the duct structures have a width W that increases stepwise at the locations of the outlet tubes 28 of the particle separators 18, 18', in the respective flue gas flow direction. Such a constant flue gas velocity renders possible a smooth flow of the gas without excessive turbulence and minimized erosion caused by fine particles remaining entrained with the gas.

The flue gas enters from each of the duct structures 50, 50' to the back pass 20 through openings 30 in the first back pass wall 32. It is possible that there is one large opening for the flue gas from each of the duct structures 50, 50', but advantageously, there are multiple substantially evenly distributed openings in first and second opening areas 54, 54', located symmetrically on opposite sides of a vertical center line of the first back pass wall 32.

The duct structures 50, 50' are advantageously made of straight tube panels, which are typically used for heating steam. The duct structures 50, 50' are advantageously constructed so as to have a planar bottom and top, and a sidewall 56 having a constant height 58, as shown in FIG. 1. In the embodiment shown in FIG. 2, the first back pass wall 32 is planar and parallel to the second short sidewall 14' of the furnace. Thereby, the first and second opening areas 54, 54' are on a common plane having a normal direction that is inclined to the first and second gas flow directions 52, 52'.

Figure 3:
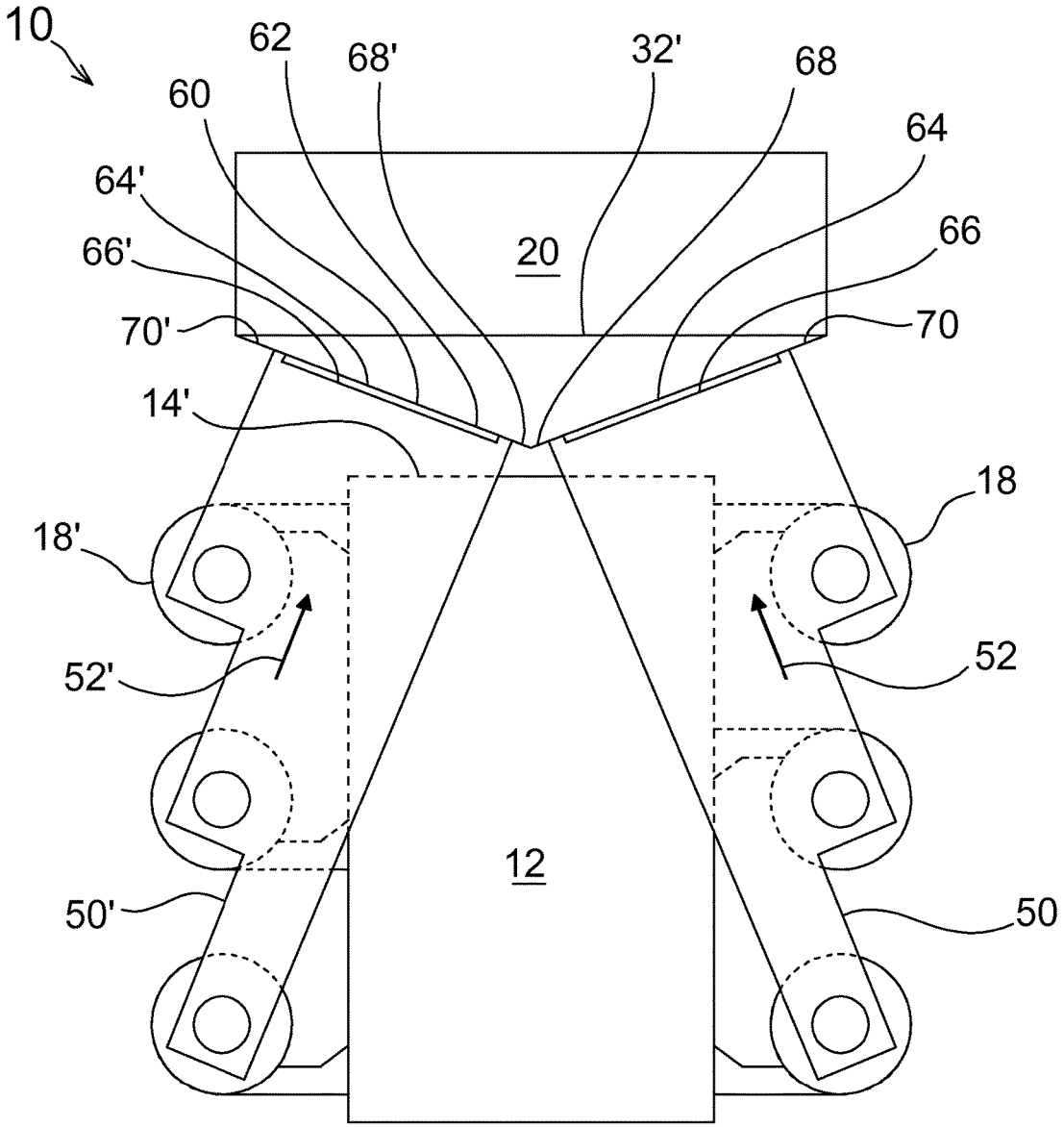
FIG. 3 is a schematic horizontal cross section of a circulating fluidized bed boiler in accordance with another preferred embodiment of the present invention.

FIG. 3 schematically shows a horizontal cross section of another embodiment of the present invention, which differs from that in FIG. 2 in that the first back pass wall 32 is not fully planar, but it comprises in its upper portion a section, a so-called connecting section 60, having a central portion 62 that protrudes towards the furnace 12. The connecting section 60 preferably has a height that is only slightly greater than the height 58, shown in FIG. 1, of the cross over duct system 22, or the duct structures 50, 50', while the lower portion 32' of the first back pass wall 32 is planar, and therein, the back pass 20 has a conventional rectangular cross section. Such a towards the furnace protruding connection section 60 provides the advantage of enabling horizontally wider gas flow paths from the particle separators 18, 18' to the back pass 20, while having a certain distance between the furnace 12 and the rectangular lower portion of the back pass 20.

The connecting section 60 comprises horizontally adjacent first and second connecting wall portions 64, 64', comprising first and second opening areas 66, 66', respectively, each of the connecting wall portions 64, 64' being inclined to the second short sidewall 14' of the furnace 12. Preferably, the connecting wall portions 64, 64' are planar, and have normal directions that are advantageously substantially parallel to the first and second gas flow directions 52, 52', respectively.

Each of the connecting wall portions 64, 64' has a central edge 68, 68' and an outermost edge 70, 70', wherein the central edges are closer to the second short sidewall 14' of the furnace than the outermost edges. According to FIG. 3, the central edges 68, 68' of the connecting walls portions 64, 64' are connected together at the center portion 62, but it is also possible that they are separated from each other. Thus, there can be between the central edges, for example, a free space for a vertical column of a supporting structure.

Figure 4:
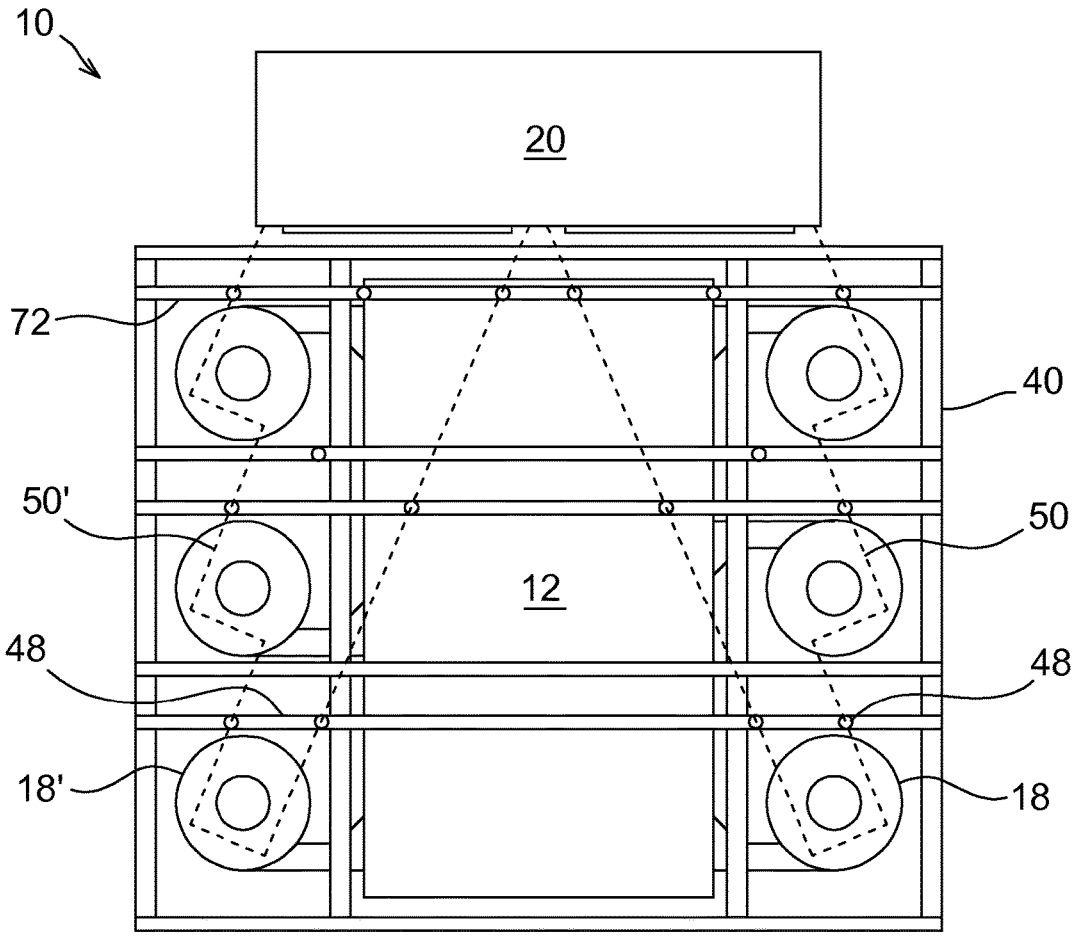
FIG. 4 is another schematic horizontal cross section of the circulating fluidized bed boiler shown in FIG. 1.

FIG. 4 schematically shows a horizontal cross section B-B of the embodiment shown in FIG. 1. The cross section B-B is taken just above horizontal beams 40, 72 of the supporting structure 36, and shows an example of locations of sliding support devices 48 of the duct systems 50, 50', on the horizontal beams.

Figure 5:
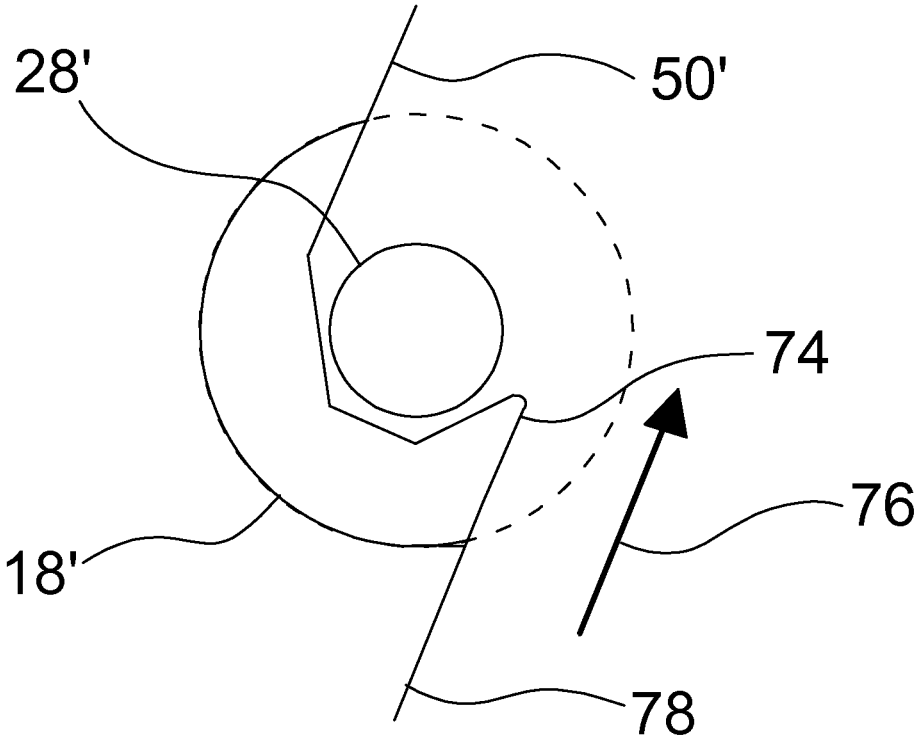
FIG. 5 is a schematic horizontal cross section of a detail of a circulating fluidized bed boiler in accordance with a preferred embodiment of the present invention.

FIG. 5 schematically shows an example of a flow guide 74 arranged in the duct system 50' adjacent to a vertical outlet tube 28' of a particle separator 18'. The flow guide 74 directs flue gas flow 76 from the gas outlet tube of an in-gas flow direction earlier particle separator to the side of the vertical extension of the gas outlet tube 28' of the in-gas flow direction later particle separator 18' for minimizing interference between the flue gas flows from the succeeding particle separators. The flow guide 74 is formed by bending the sidewall 78 of the duct structure 50' so as to form a suitable gas-directing device. The flow guide can alternatively be constructed as a separate member formed within a duct system having a simple stepwise bent sidewall 56, as shown, for example, in FIG. 2.

While the invention has been described herein by way of examples in connection with what are, at present, considered to be the most preferred embodiments, it is to be understood that the invention is not limited to the disclosed embodiment, but is intended to cover various combinations or modifications of its features and several other applications included within the scope of the invention as defined in the appended claims.

The invention claimed is:

1. A circulating fluidized bed boiler comprising:

a rectangular furnace, which is horizontally enclosed by sidewalls, for combusting fuel and combustion gas therein and generating a stream of flue gas and particles, the sidewalls comprising first and second short sidewalls and first and second long sidewalls, wherein a common width of the first and second long sidewalls is greater than a common width of the first and second short sidewalls;

multiple particle separators arranged on the side of each of the first and second long sidewalls, inlets of the multiple particle separators being connected to an upper portion of the adjacent long sidewalls, for separating particles from the stream of flue gas and particles discharged from the furnace, wherein each of the particle separators comprises a vertical gas outlet tube for discharging cleaned flue gas from the particle separator;

a back pass arranged on the side of the second short sidewall of the furnace, the back pass being horizontally enclosed by back pass walls comprising a first back pass wall facing the second short sidewall of the furnace; and a horizontally extending cross over duct system directly connected to the vertical gas outlet tubes of the particle separators for conducting the cleaned flue gas to the back pass, wherein the cross over duct system provides a straight gas flow that is angled relative to the sidewalls of the furnace from each of the vertical gas outlet tubes of the particle separators to openings in the first back pass wall.

2. A circulating fluidized bed boiler according to claim 1, further comprising a supporting system for hanging the furnace from above, wherein the cross over duct system is arranged above the supporting system.

3. A circulating fluidized bed boiler according to claim 2, wherein the cross over duct system is supported from below by the supporting system.

4. A circulating fluidized bed boiler according to claim 1, wherein the cross over duct system comprises a first duct structure providing a straight gas flow path that is angled relative to the sidewalls of the furnace from each of the gas outlet tubes of the particle separators arranged on the side of the first long sidewall of the furnace to first openings in the back pass wall, and a second duct structure providing a straight gas flow path that is angled relative to the sidewalls of the furnace from each of the gas outlet tubes of the particle separators arranged on the side of the second long sidewall of the furnace to second openings in the first back pass wall.

5. A method of assembling a circulating fluidized bed boiler according to claim 4, the method comprising lifting each of the first and second duct structures as a single piece above horizontal beams of a supporting structure of the boiler.

6. A circulating fluidized bed boiler according to claim 4, wherein each of the first and second duct structures is constructed without a partition wall.

7. A method of assembling a circulating fluidized bed boiler according to claim 6, the method comprising lifting each of the first and second duct structures as a single piece above horizontal beams of a supporting structure of the boiler.

8. A circulating fluidized bed boiler according to claim 4, wherein the first duct structure provides a straight gas flow path that is angled relative to the sidewalls of the furnace from each of the gas outlet tubes of the particle separators arranged on the side of the first long sidewall of the furnace to the first openings in the first back pass wall, and the second duct structure provides a second straight gas flow path that is angled relative to the sidewalls of the furnace from each of the gas outlet tubes of the particle separators arranged on the side of the second long sidewall of the furnace to the second openings in the first back pass wall.

9. A circulating fluidized bed boiler according to claim 8, wherein the first and second gas flow paths are mirrored symmetrically angled relative to the sidewalls of the furnace.

10. A circulating fluidized bed boiler according to claim 8, wherein each of the first and second duct structures has a constant height.

11. A circulating fluidized bed boiler according to claim 10, wherein each of the first and second duct structures has a width that increases stepwise in the respective flue gas flow.

12. A circulating fluidized bed boiler according to claim 8, wherein the first back pass wall is parallel to the second short sidewall of the furnace, and the first and second openings form a plane having a normal that is angled relative to the first and second gas flow directions.

13. A circulating fluidized bed boiler according to claim 8, wherein the first back pass wall comprises a horizontally adjacent first connecting wall portion and a second connecting wall portion, each of the connecting wall portions having a central edge and an outermost edge and being angled relative to the second short sidewall of the furnace so that the central edge of each of the first and second connecting wall portions is closer to the second short sidewall of the furnace than the outermost edge of the respective connecting wall portion, and the first openings and the second openings are located in the first connecting wall portion and in the second connecting wall portion, respectively.

14. A method of assembling a circulating fluidized bed boiler according to claim 13, the method comprising lifting each of the first and second duct structures as a single piece above horizontal beams of a supporting structure of the boiler.

15. A method of assembling a circulating fluidized bed boiler according to claim 8, the method comprising lifting each of the first and second duct structures as a single piece above horizontal beams of a supporting structure of the boiler.

16. A circulating fluidized bed boiler according to claim 4, wherein each of the duct systems comprises at least one of water and steam tubes for transferring heat from the flue gas to water or steam.

17. A circulating fluidized bed boiler according to claim 16, wherein the duct systems are made of straight water tube panels.

18. A circulating fluidized bed boiler according to claim 4, wherein each of the first and second duct structures comprises at least one flow guide for directing flue gas flow from the gas outlet tube of a first particle separator to the side of a vertical extension of the gas outlet tube of a second particle separator, wherein the first and second particle separators are arranged subsequently on the same side of a long sidewall of the furnace so that the second particle separator is closer to the back pass than the second particle separator.

19. A method of assembling a circulating fluidized bed boiler according to claim 18, the method comprising lifting each of the first and second duct structures as a single piece above horizontal beams of a supporting structure of the boiler.

* * * * *